US006681684B1

(12) United States Patent
Chen

(10) Patent No.: US 6,681,684 B1
(45) Date of Patent: Jan. 27, 2004

(54) MULTI-LAYER PLATTER APPARATUS

(76) Inventor: Hann-Kuang Chen, 7F, No. 90, Chien-Kuo 1st Rd., Lin Ya Dist., Kaohsiung City (TW)

( * ) Notice: Subject to any disclaimer, the term of this patent is extended or adjusted under 35 U.S.C. 154(b) by 0 days.

(21) Appl. No.: 10/198,468

(22) Filed: Jul. 17, 2002

(51) Int. Cl.[7] ..... A23L 1/00; A47J 27/00

(52) U.S. Cl. ..... 99/448; 99/441; 99/442; 206/509; 206/557; 211/126.2; 211/126.14; 211/133.4

(58) Field of Search ..... 99/339, 340, 426–442, 99/444–450, 485; 206/509, 557, 558, 562–564; 211/126.1, 126.2, 126.3, 133.4, 126.14

(56) References Cited

U.S. PATENT DOCUMENTS 519,580 A * 5/1894 Kelsey ..... 99/448
680,965 A * 8/1901 Distelhurst ..... 211/28
697,237 A * 4/1902 Collins ..... 34/238
1,660,521 A * 2/1928 Nordgren ..... 211/70.6
1,754,998 A * 4/1930 Geartts ..... 211/85.4
2,210,521 A * 8/1940 Bemis ..... 220/23.83
4,052,589 A * 10/1977 Wyatt ..... 219/400
4,847,461 A * 7/1989 Gilmore ..... 219/732
5,421,246 A * 6/1995 Tippmann et al. ..... 99/448
5,431,091 A * 7/1995 Couture ..... 99/401
5,794,525 A * 8/1998 Fan ..... 99/413
6,016,927 A * 1/2000 Krupp ..... 211/126.2
6,446,544 B1 * 9/2002 Creighton ..... 99/339

* cited by examiner

*Primary Examiner*—Timothy F. Simone
(74) *Attorney, Agent, or Firm*—Townsend and Townsend and Crew LLP

(57) ABSTRACT

A multi-layer platter apparatus includes an extensible elongated rod having a plurality of hollow tapered sections which are disposed concentrically one around the other in a retracted position and which are movable relative to one another along the length of the rod, the tapered sections having recesses and projections such that the recesses of each of the tapered sections interengage the projections of an adjacent one of the tapered sections in an extended position. The apparatus further includes a plurality of platters mounted respectively on the tapered sections.

5 Claims, 4 Drawing Sheets

MULTI-LAYER PLATTER APPARATUS

BACKGROUND OF THE INVENTION

1. Field of the Invention

This invention relates to a multi-layer platter apparatus, more particularly to a multi-layer platter apparatus for receiving peeled shrimps.

2. Description of the Related Art

Peeled and cooked shrimps are available from food stores, and are normally placed on a platter when served as a dish on a table. Conventionally, such platter has a body as illustrated in FIGS. 1 and 2. The body 11 of the platter 1 includes a top surface 12 and a peripheral flange 13 extending downward from the top surface 12 for enhancing the strength of the body 11. An annular concave portion 14 adjacent to the peripheral flange 13 and an annular convex portion 15 in conjunction with and surrounded by the concave portion 14 are formed on the top surface 12 of the body 11 for positioning the peeled shrimps 16. Since the above described platter 1 has a limited capacity, several platters 1 of shrimps may be required in order to provide sufficient servings of the shrimps. As such, the space required for accommodating the platters 1 increases with the number of the platters 1.

SUMMARY OF THE INVENTION

Therefore, it is an object of the present invention to provide a multi-layer platter apparatus that occupies a relatively small amount of space on a table while accommodating a relative large quantity of shrimps.

Accordingly, a multi-layer platter apparatus of the present invention comprises: an extensible elongated rod having a plurality of hollow tapered sections which are disposed concentrically one around the other in a retracted position and which are extendable one above the other to an extended position, said tapered sections having recesses and projections such that said recesses of each of said tapered sections interengage said projections of an adjacent one of said tapered sections in the extended position, each of said tapered sections having a tapered outer surface; and a plurality of platters mounted respectively on said tapered sections, each of said platters having a central hole with a tapered inner surface, said tapered inner surface of each of said platters abutting against said outer surface of a respective one of said tapered sections in the extended position.

BRIEF DESCRIPTION OF THE DRAWINGS

In drawings which illustrate embodiments of the invention.

DETAILED DESCRIPTION OF THE PREFERRED EMBODIMENTS

Figure 3:
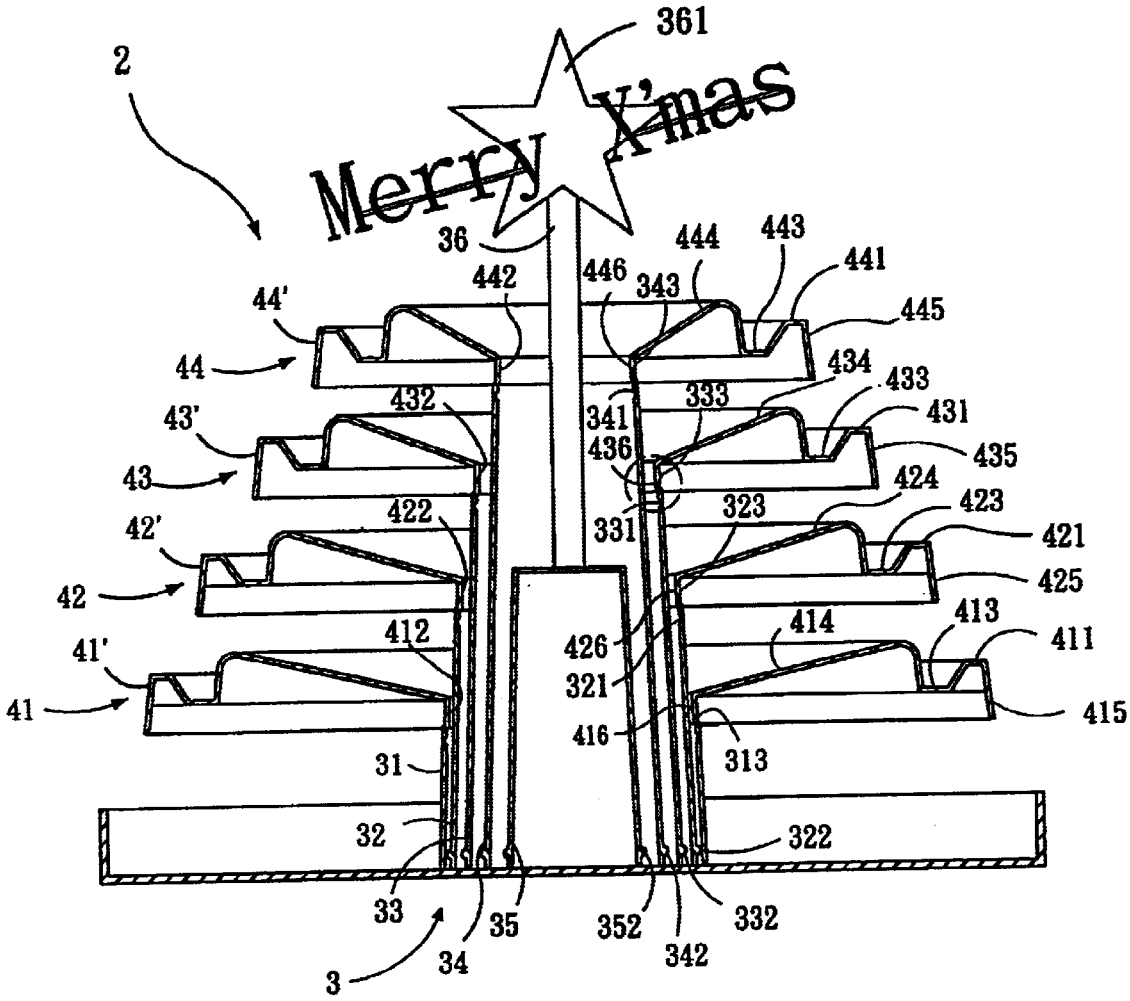
FIG. 3 is a schematic side view of a multi-layer platter apparatus embodying this invention.

FIG. 3 illustrates a multi-layer platter apparatus 2 embodying this invention. The multi-layer platter apparatus 2 includes an extensible elongated rod 3 having five hollow tapered sections 31, 32, 33, 34, 35 which are disposed concentrically one around the other in a retracted position and which are movable relative to one another along the length of the rod 3. The apparatus 2 further includes four platters 41, 42, 43, 44 which are mounted on the rod 3 and which are gradually reduced in size from bottom to top.

Figure 4:
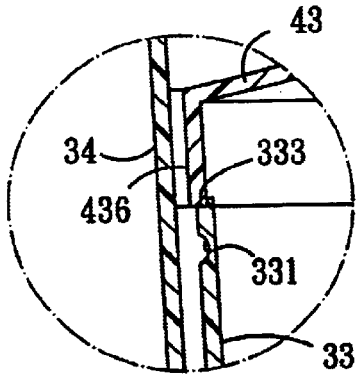
FIG. 4 is an enlarged sectional view of an encircled portion of FIG. 3.

Referring now to FIG. 4, in combination with FIG. 3, the top ends of the tapered sections 31, 32, 33, 34 are provided with top shoulders 313, 323, 333, 343, respectively. The platters 41, 42, 43, 44 include bodies 41', 42', 43', 44' having top surfaces 411, 421, 431, 441 and central holes 412, 422, 432, 442 formed at the center of the top surfaces 411, 421, 431, 441 and confined by central flanges 416, 426, 436, 446, respectively. The central flanges 416, 426, 436, 446 extend downward from the top surfaces 411, 421, 431, 441, and are seated on the top shoulders 313, 323, 333, 343 of the tapered sections 31, 32, 33, 34, respectively, when the tapered sections 31, 32, 33, 34, 35 of the rod 3 are in the retracted position.

Figure 5:
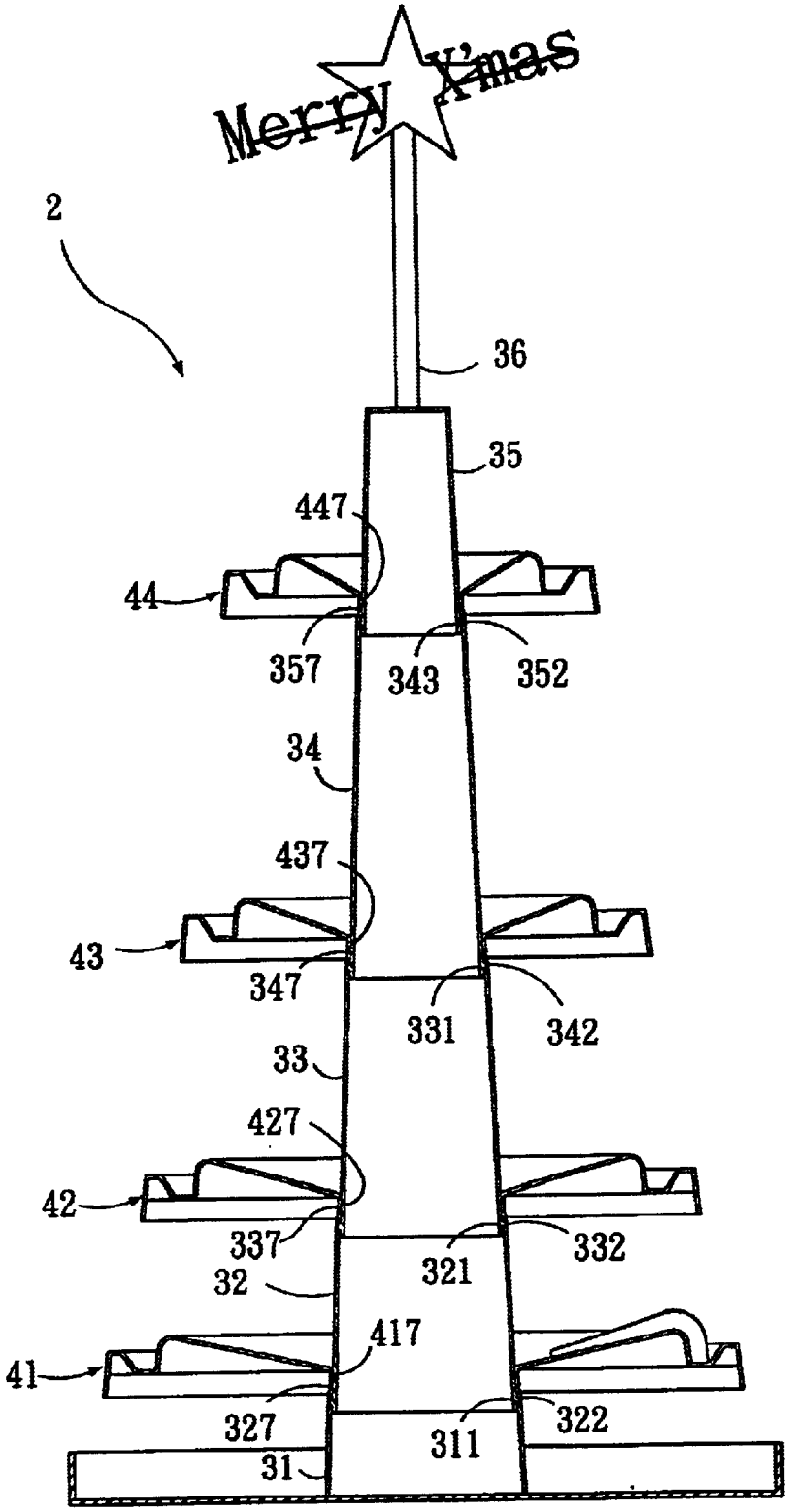
FIG. 5 is a schematic side view of the multi-layer platter apparatus of FIG. 3 in an extended position.

Referring now to FIG. 5, in combination with FIGS. 3 and 4, the rod 3 is provided with recesses 311, 321, 331, 341 formed on inner sides of the tapered sections 31, 32, 33, 34 adjacent to and below the top shoulders 313, 323, 333, 343, respectively. The bottom ends of the tapered sections 32, 33, 34, 35 are provided with projections 322, 332, 342, 352 which interengage the recesses 311, 321, 331, 341 of the tapered sections 31, 32, 33, 34, respectively, when the tapered sections 31, 32, 33, 34, 35 of the rod 3 are moved relative to one another to an extended position. As illustrated in FIG. 5, the central flanges 416, 426, 436, 446 have tapered inner surfaces 417, 427, 437, 447 abutting against tapered outer surfaces 327, 337, 347, 357 of the tapered sections 32, 33, 34, 35, respectively, so as to position the platters 41, 42, 43, 44 on the rod 3.

Figure 1:
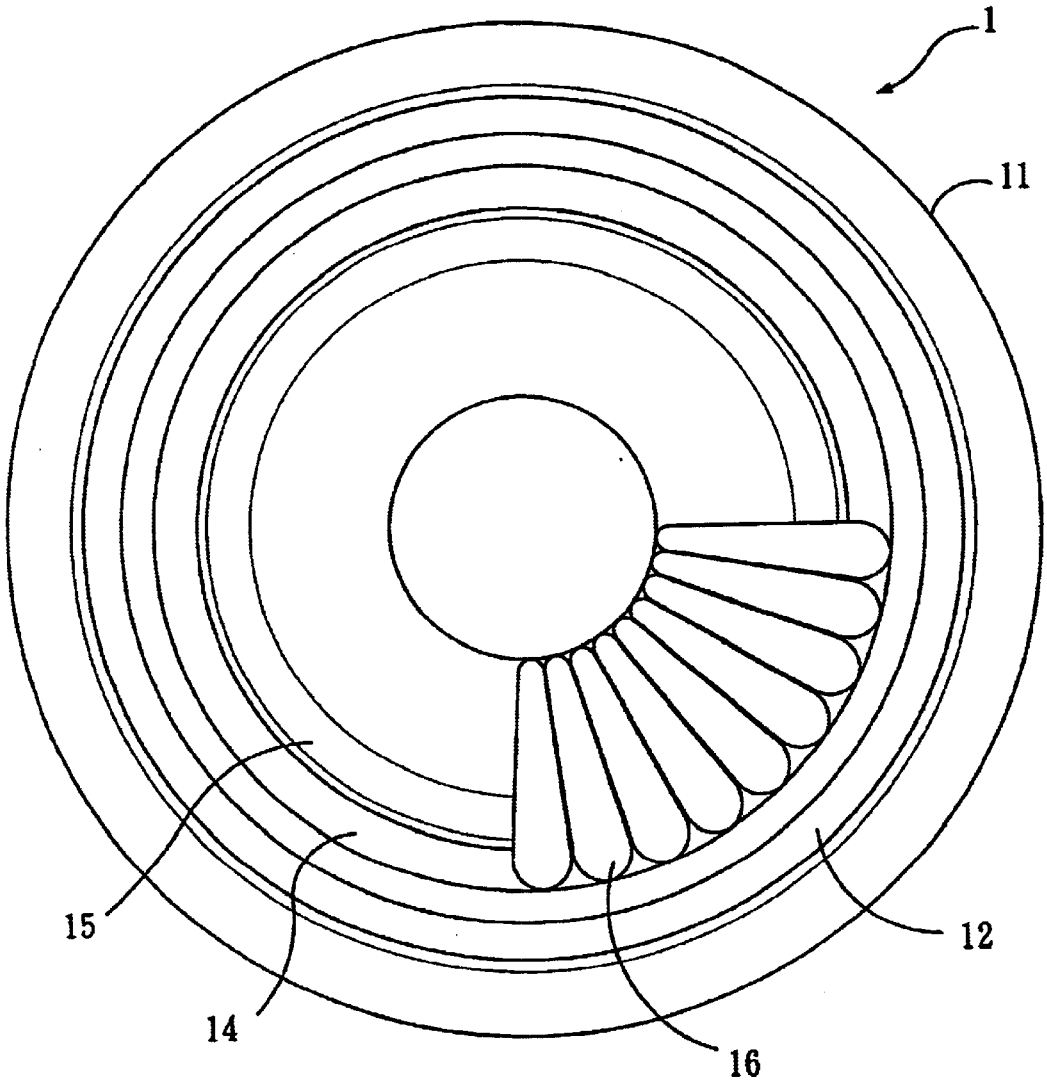
FIG. 1 PRIOR ART
FIG. 1 is a schematic top view of a conventional platter.
Figure 2:
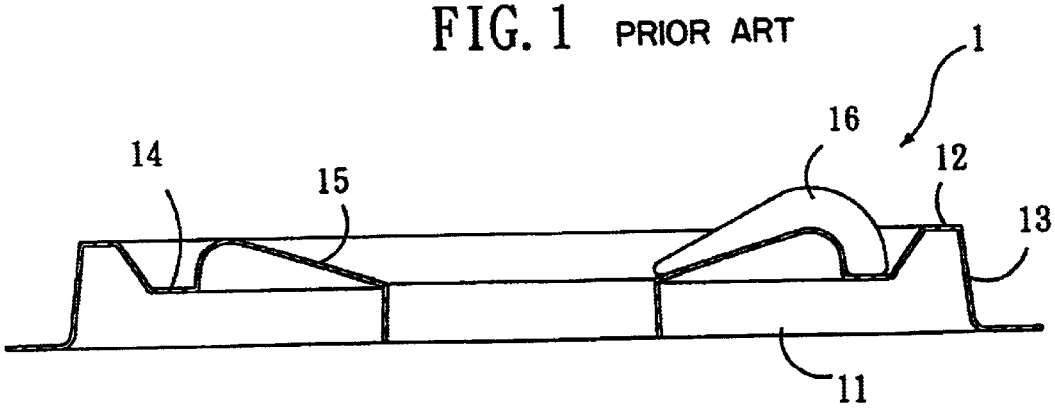
FIG. 2 PRIOR ART
FIG. 2 is a schematic side view of the platter of FIG. 1.

Each of the platters 41, 42, 43, 44 may have a configuration similar to that of the conventional platter 1 shown in FIGS. 1 and 2. As such, the bodies 41', 42', 43', 44' of the platters 41, 42, 43, 44 may be provided with peripheral flanges 415, 425, 435, 445, concave portions 413, 423, 433, 443 adjacent to the peripheral flanges 415, 425, 435, 445, and convex portions 414, 424, 434, 444 in conjunction with the concave portions 413, 423, 433, 443. The peripheral flanges 425, 435, 445 may extend downward from the top surfaces 421, 431, 441 to abut against the bodies 41', 42', 43' in the retracted position. The concave portions 413, 423, 433, 443 and the convex portions 414, 424, 434, 444 are formed on the top surfaces 411, 421, 431, 441 between the peripheral flanges 415, 425, 435, 445 and the central flanges 416, 426, 436, 446, respectively, for positioning the shrimps on the apparatus 2. The top of the innermost tapered section 35 may be further provided with a decoration 36 so that when the innermost tapered section 35 is pulled outward and upward via the decoration 36, the rod 3 is placed in the extended position.

Figure 6:
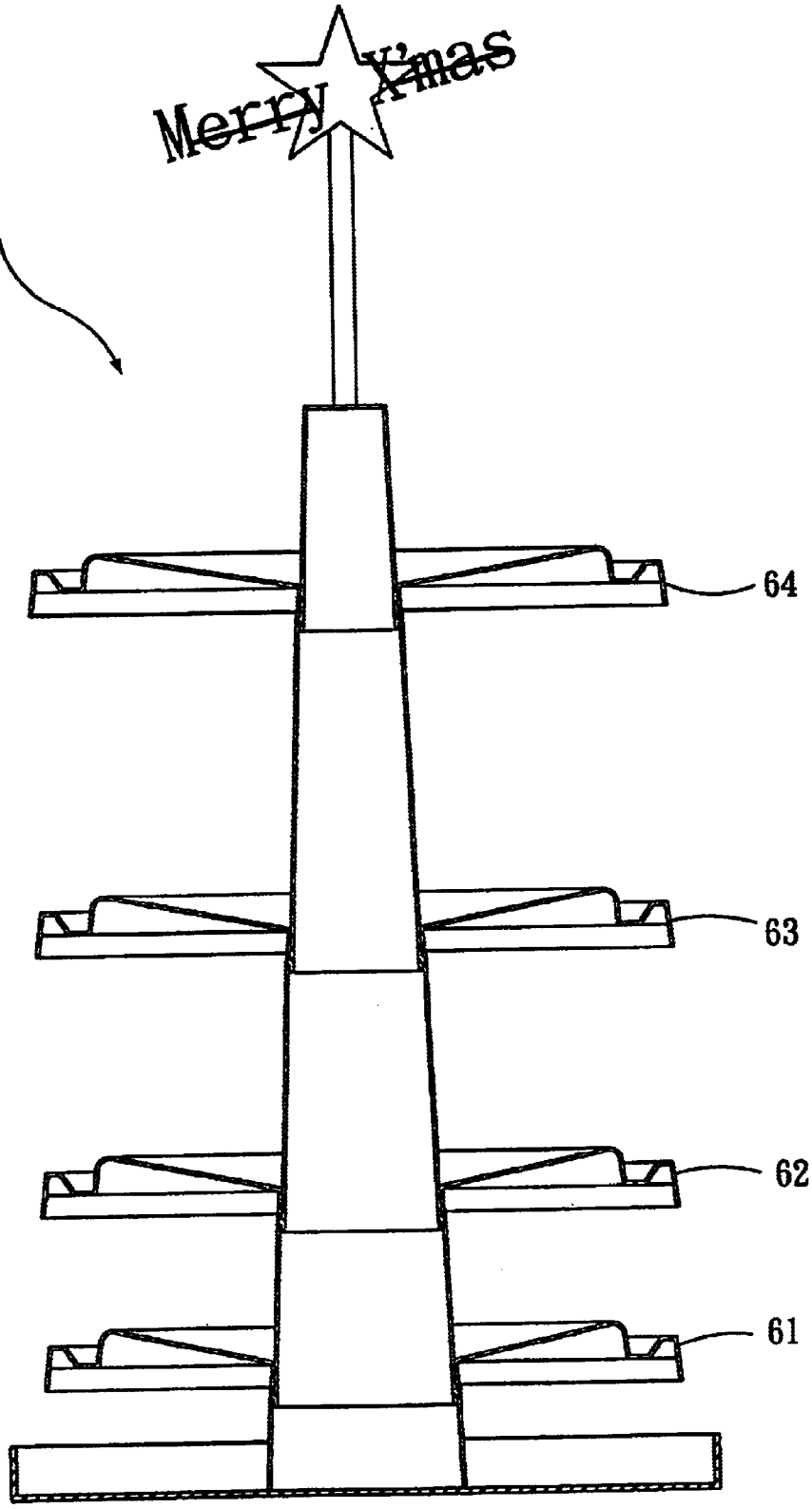
FIG. 6 is a schematic side view of another embodiment of the multi-layer platter apparatus of this invention modified from FIG. 5.

FIG. 6 illustrates another embodiment of the multi-layer platter apparatus 6 of this invention. The configuration of the multi-layer platter apparatus 6 is similar to the above described apparatus 2 except for the platters 61, 62, 63, 64 which have the same size and dimension.

The multi-layer arrangement and the retractability of the multi-layer platter apparatus 2 of this invention provide the advantages that the space required for accommodating large quantity of shrimps, such as when served as a dish on a table, can be significantly reduced, and the transport and the distribution of the shrimps are facilitated.

With the invention thus explained, it is apparent that various modifications and variations can be made without departing from the spirit of the present invention. It is therefore intended that the invention be limited only as recited in the appended claims.

I claim:

1. A multi-layer platter apparatus for receiving peeled shrimps, comprising:

an extensible elongated rod having a plurality of hollow tapered sections which are disposed concentrically one around the other in a retracted position and which are extendable one above the other to an extended position, said tapered sections having recesses and projections such that said recesses of each of said tapered sections interengage said projections of an adjacent one of said tapered sections in the extended position, each of said tapered sections having a tapered outer surface; and a plurality of platters mounted respectively on said tapered sections, each of said platters having a central hole with a tapered inner surface, said tapered inner surface of each of said platters abutting against said outer surface of a respective one of said tapered sections in the extended position.

2. The multi-layer platter apparatus of claim 1, wherein each of said platters includes a body having a top surface and an central flange confining said central hole and projecting downward from said top surface, each of said tapered sections having a top and a top shoulder formed on said top, said central flange of each of said platters being seated on said top shoulder of an adjacent one of said tapered sections in the retracted position.

3. The multi-layer platter apparatus of claim 2, wherein said body of each of said platters further includes a peripheral flange extending laterally downward from said top surface to abut against said top surface of an adjacent one of said platters in the retracted position.

4. The multi-layer platter apparatus of claim 3, wherein said top surface includes a convex portion adjacent to said central flange and a concave portion in conjunction with said convex portion and adjacent to said peripheral flange for positioning the shrimps.

5. The multi-layer platter apparatus of claim 1, wherein said tapered sections include an innermost tapered section which can be pulled upward and outward to place said rod in the extended position.

* * * * *